US005181335A

United States Patent [19]

Todd

[11] Patent Number: 5,181,335

[45] Date of Patent: Jan. 26, 1993

[54] PORTABLE SIGN INSTALLATION KIT AND METHOD OF USING SAME

[75] Inventor: Harry V. Todd, El Cajon, Calif.

[73] Assignee: T. Diamond Enterprises, El Cajon, Calif.

[21] Appl. No.: 808,202

[22] Filed: Dec. 13, 1991

Related U.S. Application Data

[63] Continuation of Ser. No. 625,932, Dec. 10, 1990, abandoned.

[51] Int. Cl.[5] ..... G09F 15/00

[52] U.S. Cl. ..... 40/607; 248/125; 248/156

[58] Field of Search ..... 40/606, 607; 248/125, 248/156, 545

[56] References Cited

U.S. PATENT DOCUMENTS 4,233,769 11/1980 Archer ..... 40/607

FOREIGN PATENT DOCUMENTS

WO85/05716 12/1985 World Int. Prop. O. ..... 40/607

*Primary Examiner*—Kenneth J. Dorner
*Assistant Examiner*—S. Bonifanti
*Attorney, Agent, or Firm*—Bernard L. Kleinke; Jerry R. Potts; William Patrick Waters

[57] ABSTRACT

A sign mounting arrangement and installation kit, and method of using them, for enabling, without the use of any tools, the installation of a portable sign in a very simple and straightforward manner. The portable sign mounting arrangement includes a pair of open slot mounting brackets and hand-activated clamping devices for clamping a display sign between a conventional sign post standard and the edges of the slots in each of the brackets.

18 Claims, 2 Drawing Sheets

PORTABLE SIGN INSTALLATION KIT AND METHOD OF USING SAME

This is a continuation of application Ser. No. 625,932, filed on Dec. 10, 1990, now abandoned.

DESCRIPTION

1. Technical Field

The present invention relates, in general, to a sign installation kit or system and method for mounting signs and more particularly to a portable sign mounting arrangement and installation kit and method of using it for quick and easy installation and assembly of a display sign.

2. Background Art

Today's modern real estate practices require sellers of real estate to advertise vigorously the sale of their property through a variety of methods. One of the more successful methods is the erection of a large property for sale sign on the property to be sold, oftentimes accompanied by a number of other smaller signs installed in a variety of areas surrounding the subject property.

With respect to the installation of the aforementioned signs, the larger sign is generally installed on a semi-permanent basis until the property is sold, while the smaller signs are usually installed on a temporary basis, usually for less than a single day for display messages such as "open house". In this regard, the deployment of and ease of installing such smaller signs becomes of paramount importance.

Therefore it would be highly desirable to have a portable sign mounting arrangement and installation kit that is very convenient to use.

Prior known real estate sign systems and mounting arrangements have not generally been convenient to use and oftentimes may have resulted in lost sale opportunities. In this regard, once an owner makes a decision to place his or her property on the market for sale, the owner usually employs an agent to advertise and sell the subject property. Such an agent oftentimes will drive many miles to inspect the property and to install the aforementioned property for sale signs. For such advertising efforts an agent may have many different types and kinds of signs, and different types and kinds of mounting standards. In this regard, should an agent, for example, mistakenly forget to bring a properly sized sign for a given standard or, conversely, forget a post standard, valuable time can be lost in the agent returning to his or her office to acquire a properly sized sign or post.

Still other delays and problems can develop if such mounting arrangements and systems require special tools, such as screwdrivers, hammers and the like. In this regard, if the agent forgets a special installation tool, or brings the wrong tool, valuable time and sales opportunities can be lost.

Another problem with prior known systems is that oftentimes the display signs are loosely mounted and are subject to being jarred askew or completely dislodged by external forces such as the wind and vandals. In this regard, if the sign is not mounted securely, lost sales opportunities may result. For example, if the portable for sale sign is dislodged, a person passing near the sign location will not become aware of the advertised property. Similarly, if the portable sign is knocked askew, a potential buyer may attribute a jarred sign to an undesirable piece of property, resulting in a lost sales opportunity.

Therefore it would be highly desirable to have a new and improved portable sign mounting arrangement and installation kit that mounts a sign securely so that it is not easily subject to external stresses, such as the wind and the like, or to easy vandalism.

There have, of course, been many different types and kinds of sign mounting arrangements directed at solving the aforementioned problems. For example, reference may be made to the following U.S. Pat. Nos. 2,552,745; 3,310,899; 4,233,769; 4,417,237; 4,717,110; 4,793,083; and 4,939,037.

While the sign holding or mounting arrangements disclosed in the foregoing patents may be satisfactory for some applications, they have not generally solved the aforementioned problem as such mounting arrangements have been limited to the utilization of either special types and kinds of mounting poles or signs, or have required the use of special tools, such as screwdrivers and the like, for assembly and display purposes.

For example, U.S. Pat. No. 4,717,110 discloses a sign mounting arrangement that employs a U-shaped vertical mounting post for supporting a sign between a pair of spaced-apart clamping crossbar members. The mounting post is adapted to be supported in a blade-shaped adapter, frictionally mounted between a pair of vertically projecting elongated flanges integrally joined to a flat supporting base plate unit. While such an arrangement could be assembled by a user without the use of any special tools, the disclosed system requires not only a specially constructed support post, but also a sign constructed specially so that its height is dimensioned to be secured between the clamping crossbar members. Also, because the blade-shaped adapter is mounted frictionally, it could, if jarred by an external force, such as a passing child, permit the mounting post and its supported sign to be knocked askew or completely dislodged from the base unit.

As another example, U.S. Pat. No. 4,233,769 discloses a real estate sign support system with a slotted mounting post and a pair of channeled crossbar members, each having a clasp. The clasp of each crossbar member is adapted to be received in any one of the slots on the mounting post. The post includes a lower end which can be inserted into the ground by way of a foot peg cantilevered therefrom. Again, while such a system could be assembled by a user without the use of any special tools, the mounting system requires a specially designed slotted mounting post, Moreover, the thickness of the sign must generally be conformed to the gap width of the channel in each of the crossbar members. In this regard, if the thickness of the sign is not generally conformed to the gap width of the channels, a vandal, for example, can easily and quickly remove the sign from its mounting standard.

Therefore it would be highly desirable to have a new and improved portable sign mounting arrangement and method of using it with different types and kinds of mounting posts and signs in an easy to install manner, without the use of any special tools such as screwdrivers, hammers and the like.

DISCLOSURE OF INVENTION

Therefore, the principal object of the present invention is to provide a new and improved portable sign mounting arrangement and kit which can be readily used in a very simple and straightforward manner with a variety of different size signs and mounting posts, and which can be installed without the use of any special tools.

Another object of the present invention is to provide such a new and improved portable sign mounting arrangement and kit and method of using them which mounts securely a sign so that it is not easily subject to external stresses, such as the wind and the like, or to easy vandalism.

Still yet another object of the present invention is to provide such a new and improved portable sign mounting arrangement and kit which is relatively inexpensive to manufacture, and which is aesthetically pleasing in appearance.

Briefly, the above and further objects of the present invention are realized by providing a sign mounting arrangement and kit, and method of using them, for enabling, without the use of any tools, the installation of a portable sign in a very simple and straightforward manner.

The portable sign mounting arrangement includes a pair of open slot mounting brackets and hand-activated clamping devices for clamping a display sign between a conventional sign post standard and the edges of the open slots in each of the brackets. The kit includes the mounting arrangement, a sign and a post standard with a convenient foot platform for facilitating the driving of the standard into the ground.

The current invention is useful for the installation of a portable sign by a user without the need of any special tools. In this regard, the mounting arrangement and kit provides several advantages when compared to previously known devices.

Firstly, it is fully versatile in that it enables portable signs of many different sizes to be installed to any conventional post standard whether of a cylindrical, L-shaped, U-shaped or rectangularly shaped construction.

The mounting arrangement and installation kit is practical in that it can be stowed in a conventional bag or other convenient storage container, and thus, can be stored easily. It is also easily transportable.

The portable sign mounting arrangement and kit are relatively inexpensive to manufacture and enables a user to easily secure a portable sign to a conventional post standard. In this regard, the sign is secured to the post with sufficient force so that the sign is secure against normal external stresses such as wind and other external forces. Moreover, the sign is secured in such a manner that the sign cannot be removed from the mounting arrangement by a simple sliding motion and thus, the inventive mounting arrangement and method of the installation makes the sign less susceptible to vandalism.

Finally, the mounting arrangement and kit does not require the use of any special tools for assembly or installation purposes. In this regard, assembly and installation of the portable sign can be accomplished by simply using the muscle power of the legs and hands of a user.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
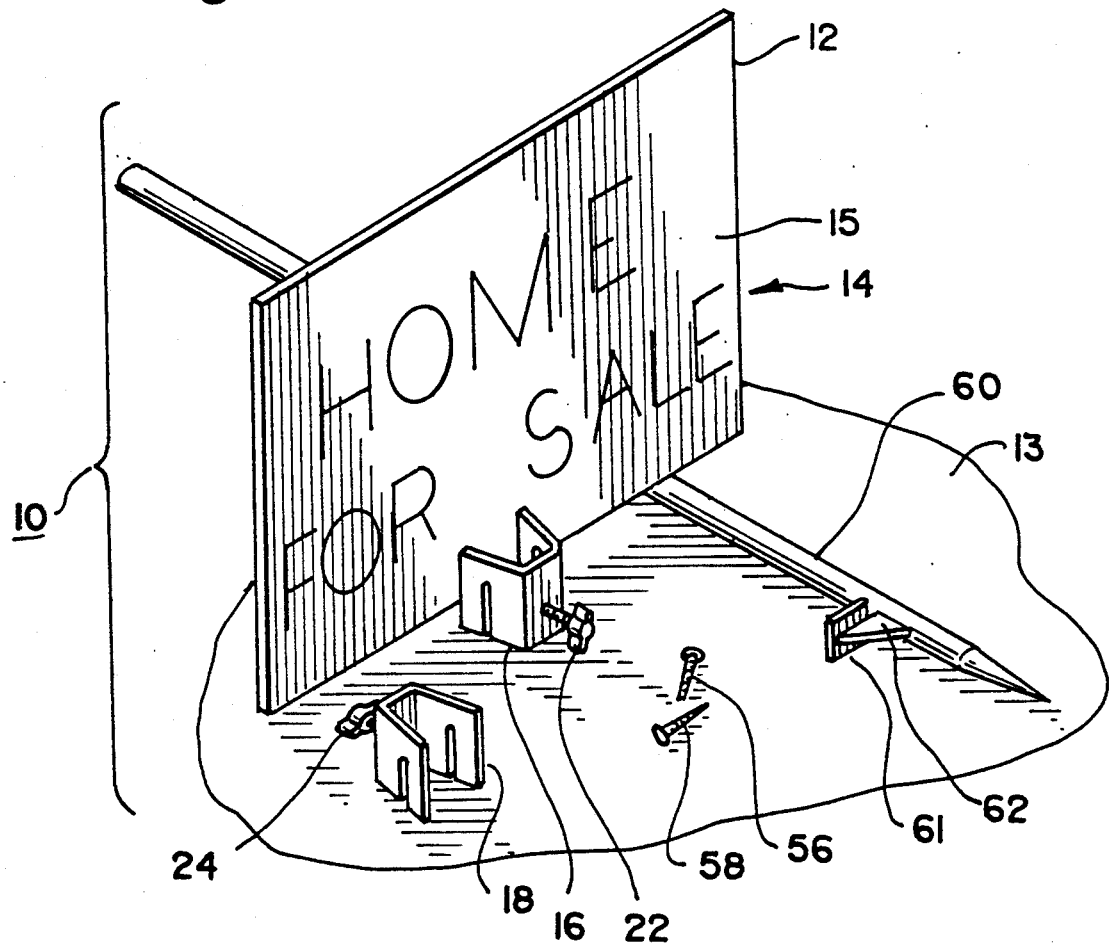
FIG. 1 is a pictorial view of a portable sign installation kit comprising a sign, a conventional post standard, and a mounting arrangement, which are constructed in accordance with the present invention.

Referring now to the drawings, and more particularly to FIG. 1 thereof, there is shown a portable sign installation or mounting kit 10, which is constructed in accordance with the present invention. The kit 10 is used according to the method of the present invention, to install a portable sign, indicated at 12 in FIG. 1, so that the sign 12 is supported at sufficient height above a ground support surface 13, so that indicia shown generally at 14 disposed on the front face 15 of the sign 12 may be clearly viewed by any casual observer (not shown).

The kit 10 generally comprises a pair of supporting devices or brackets 16 and 18 for holding or supporting a lower marginal edge portion 17 and a upper marginal edge portion 19, respectively, of the sign 12 in a stationary manner; a mounting standard or post 60 for holding the sign 12 above the ground surface 13; and a pair of hand-activated clamping devices or screws 22 and 24 for clamping the lower portion 17 and upper portion 19 of the sign 12 and the brackets 16 and 18 respectively to the mounting standard 60. The kit 10 also includes a pair of conventional Phillips-head screws 56 and 58 for emergency purposes. The kit 10 is utilized to install a portable sign, such as sign 12, in a stationary manner at a sufficient height above the ground surface 13 so that a casual observer passing near the location of the sign is able to easily and clearly read the indicia 14 disposed on the face 15 of the sign 12. The method of installing the sign 12 will be described hereinafter in greater detail.

Considering now the supporting devices or brackets 16 and 18 in greater detail, each of the brackets 16 and 18 are substantially identical to one another so only bracket 16 will now be described.

Figure 4:
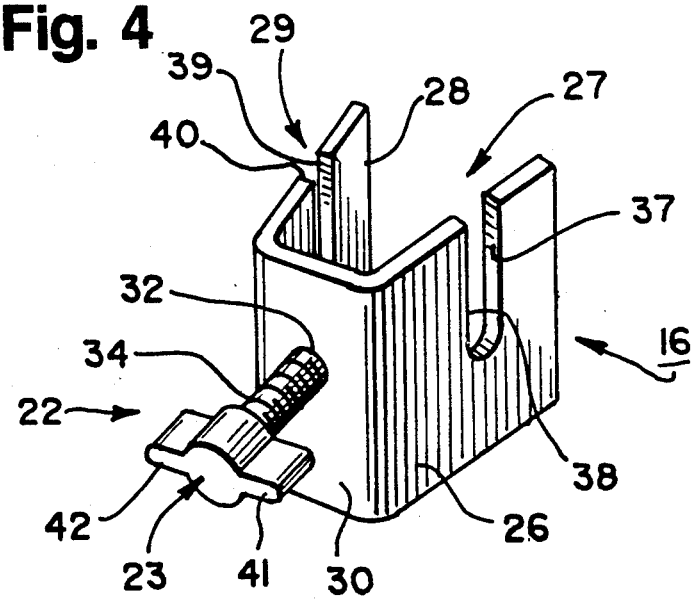
FIG. 4 is an enlarged pictorial view of one of the mounting brackets of FIG. 1.

Referring now to FIG. 4, the supporting bracket 16 is generally U-shaped and is constructed of a suitable light-weight thermoplastic material such as polypropylene or ABS plastic. The bracket 16 includes a pair of flared leg or side wall portions 26 and 28 converging toward an integrally connected back wall portion or bight portion 30. Bight portion 30 is substantially shorter than leg portions 26 and 28. The leg portions 26 and 28 and bight portion 30 are of equal height and have a uniform cross section, giving the bracket 16 a general U-shape. Legs 26 and 28 are flexible toward one another and resilient so when deformed toward one another and released, they return to their original unstressed positions relative to one another.

For the purpose of supporting the sign 12, each of the legs 26 and 28 include an open slot, such as an open slot 27 and 29 respectively. Slots 27 and 29 are in general alignment, equally dimensioned and spaced apart a sufficient distance to support the bottom and top portions of a variety of different types and sizes of signs. The depth of each slot 27 and 29 approximates about three quarters of the height of each respective leg 26 and 28. As slots 27 and 29 are in general alignment with one another, but not parallel to one another, the slots 27 and 29 will accommodate a relatively thin sign without deforming the legs 26 and 28. For thicker signs, a user may stress or deform legs 26 and 28 toward one another to urge slots 27 and 29 toward a parallel disposition, to permit a thicker sign to be inserted into the slots 27 and 29. Thus, signs of various thicknesses can be easily accommodated within the bracket 16.

In order to support one of the clamping devices, such as device 22 relative to the sign 12 and the standard such as the standard 60 (FIG. 1) or a standard 20 (FIGS. 2 and 3); the bracket 16 includes a hole 32 which is disposed longitudinal axis of the bight portion 30 slightly above its center. The hole 32 is dimensioned to receive and support threadably the device 22.

Figure 3:
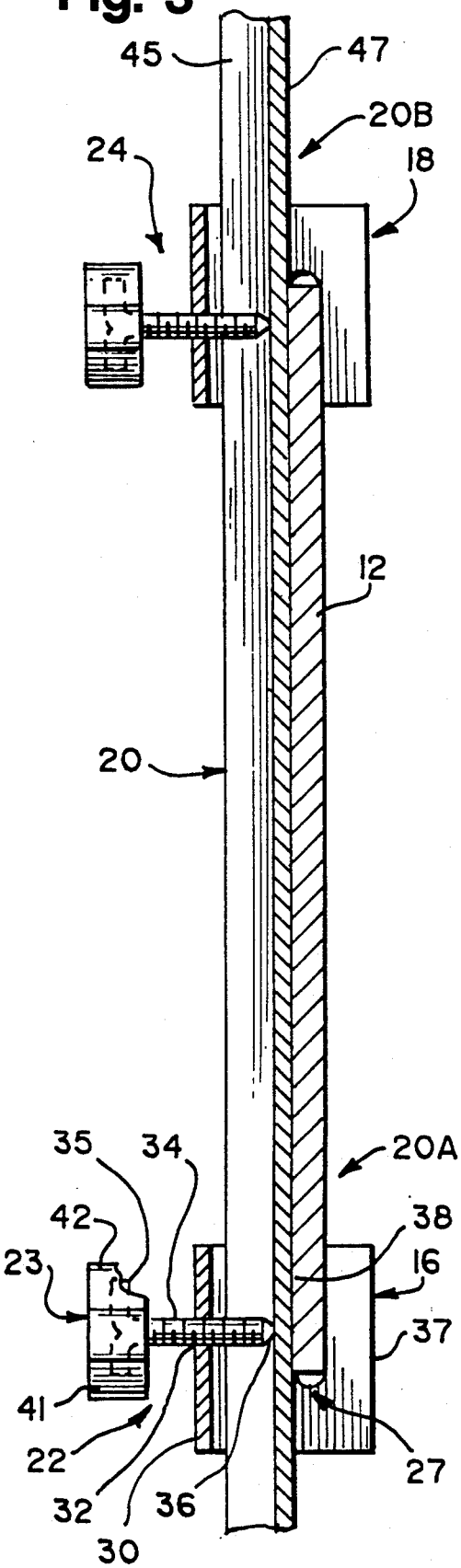
FIG. 3 is a partially cut-away, cross-sectional view of the mounting arrangement of FIG. 2 taken along line 3—3.

Considering now the hand-activated clamping devices or screws 22 and 24. Each device is similar, so only device 22 will now be described. Referring to FIGS. 3 and 4, the hand-activated device 22 generally includes a hex head sheet metal screw 34 for threadably passing through hole 32 a sufficient distance so that a tip portion 36 of the screw 34 can extend beyond a back edge portion of each of the respective slots 27 and 29, such as slot back edge portions 37 and 39 respectively. The sheet metal screw 34 includes a hex head 35.

Figure 2:
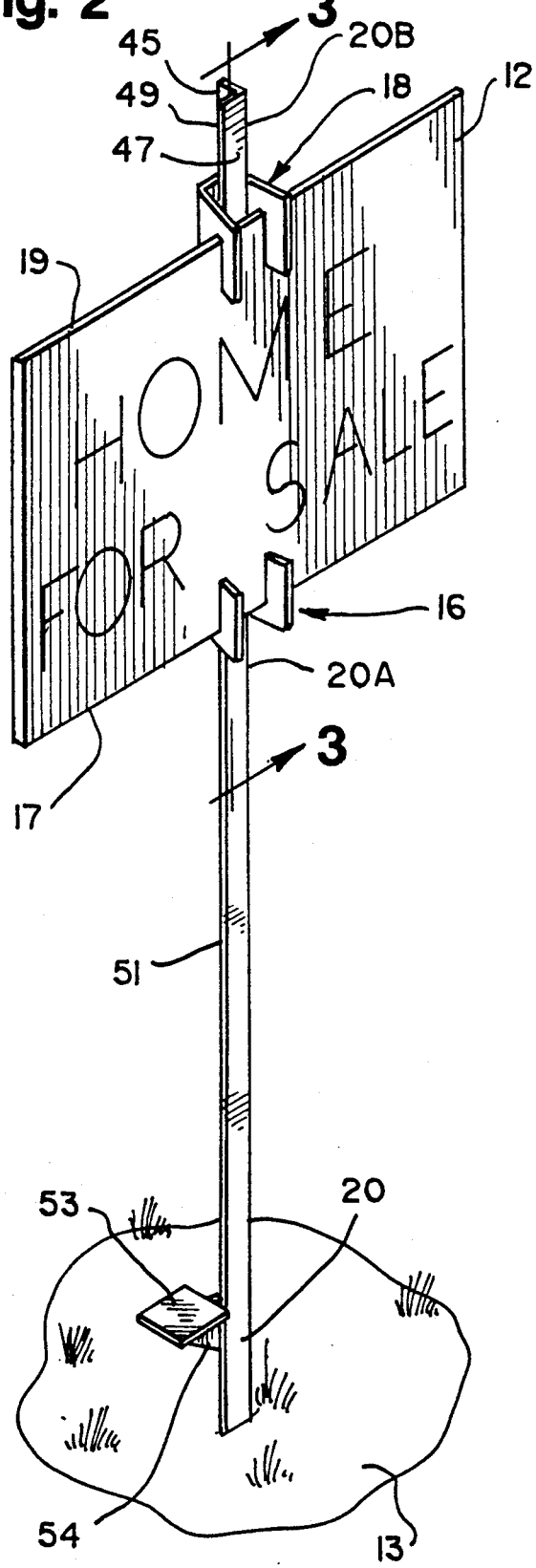
FIG. 2 is a pictorial view of a mounting arrangement which is constructed in accordance with the present invention, and which shows a sign and conventional post standard.

For the purpose of enabling the device 22 to be rotated or screwed through hole 32 by hand, the head 35 of the screw 34 is bonded to a smooth plastic member 23. The member 23 is generally a body section having a central body portion 40 of uniform cross-sectional thickness which is circular in its cross-sectional area and a pair of arms 41 and 42 which extend laterally from the circular portion 40 in diametrically opposite directions from the longitudinal center of the body portion 40 to form a T shape with screw 34. The arms 41 and 42 have a sufficient length so that a user (not shown) may easily grasp member 23 and rotate the screw 34 threadably through hole 32 for clamping or securing purposes. Member 23 is composed of any suitable thermoplastic material such as polypropylene or ABS plastic and is fixed to the head 35 of screw 34 by any convenient thermoplastic/metal bonding technique, such as injection molding. Considering now the use of the kit 10 in greater detail with reference to FIGS. 1 through 4, as indicated in FIGS. 1 and 2, a user initially installs a mounting post or standard such as the standard 60 (FIG. 1) or a standard 20 (FIGS. 2 and 3) into the ground surface 13 by using the hands and weigh the user.

After driving the mounting standard such as the mounting standard 20 into the ground surface 13, the user places one of the brackets, such as bracket 16, with its open slots 27 and 29 extend upwardly, around a lower portion 20A of the standard 20. In this regard, the user slides the open end of the bracket 16 around the standard 20 until the back wall or bight portion 30 engages a narrow edge 49 of the standard 20. The sign 12 includes the front face portion 15 and an obverse or rear face portion 25. For purpose of orienting the sign 12 properly in the slots 27 and 29, the front face portion 15 of the sign 12 is placed adjacent to the back edge portions 37 and 39 of slots 27 and 29 respectively. This assures the post 20 will be adjacent to the obverse side 23 of the sign 12 and will not interfere with the indicia 14 disposed on the front face 15 of the sign 12. Indicia 14 may be any type of informational communication, such as a "for sale" message.

The user temporarily holds the bracket 16 in place relative to the standard 20 with the hand of the user. With the other hand of the user, the user places the center part of the lower portion 17 of the sign 12 into the open slots 27 and 29 for supporting purposes.

Once the sign 12 is supported in slots 27 and 29, the user begins to rotate the member 23 to cause the tip portion of the screw 34 to screw into and through the hole 32 disposed in the back wall or bight portion 30 of the bracket 16. The user continues to rotate the member 23 by hand until the tip portion 36 of the device 22 engages the mounting standard 20, forcing the standard 20 to press the lower part of the sign 12 between the slot edges 37 and 39 and the mounting standard 20 with sufficient force to secure the bracket 16 to the standard 20. In this regard, the standard 20 is clamped between the device 22 and the sign 12, thus affixing the mounting bracket 16 to the standard 20. In a similar manner, as the sign 20 is wedged or clamped between the edge portions 37 and 39 of the slots 27 and 29 respectively and the standard 20, the sign 12 is tensioned within the slots 27 and 29 to secure the sign 12 in place between the mounting bracket 16 and the standard 20.

The user then places the second bracket 18 around a upper portion 20B of the post 20 with the slots in bracket 18 extending downwardly and engaging the upper portion 19 of the sign 12. The user then rotates the device 24 by hand in the same manner as described above with respect to device 22, until the bracket 18 and sign 12 are secured to the upper portion 20B of the post 20.

Considering now the mounting post or standard 20 in greater detail with reference to FIGS. 2 and 3, the post 20 is generally an L-shaped angle iron having a pair of integrally connected leg members 45 and 47 respectively. Leg members 45 and 47 are of equal width and cross sectional area. The width of the back walls of the brackets 16 and 18 are both slightly smaller than the width of either leg member 45 or leg member 47 for the purpose of providing the user with a visual indication for proper orientation of the clamping devices 16 and 18 relative to the L-shaped post 20. In this regard, a user cannot orient the widest portion of either one of the leg members 45 or 47 immediately adjacent to the bight portion 30. This helps the user to place the bracket 16 (and 18) in proper orientation to the post 20 by placing either one of a narrow edge or flat portion, such as narrow edge portion 49 or 51 immediately adjacent to the bight portion 30.

As best seen in FIGS. 2 and 3, the width of the leg members 45 and 46 approximates the distance between a front edge portion of the slots, such as front edge portion 38 or 40 of slots 27 and 29 respectively, and the bight portion 30 of the bracket 16. This manner of arrangement is to assure that a face portion of the post 20 will be disposed against the sign 12.

As best seen in FIG. 2, the post 20 includes a foot peg or step platform 53 for facilitating driving the post 20 into the ground surface 13 without the aid of any tools. In this regard, a user, by placing an end portion of the post against the ground surface 13, with the post in an upright position, can step on the platform to use the user's weight to drive the post 20 into the ground surface 13 so that it is secured in an upright manner. The platform 53 is secured to the post 20 by an angle iron or brace 54 which is welded between the post 20 and the platform 53.

While in the preferred form of the present invention, the post 20 is an L-shaped angle iron, it will be understood by those skilled in the art that of shapes of posts can be utilized equally well, such as the circular post 60 with a foot platform 61 and brace 62 (FIG. 1).

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A portable sign support kit, comprising:

a sign for displaying a message, said sign including front and rear flat face portions, upper and lower portions, and upper and lower marginal edges, without rearwardly extending protrusions;

a mounting standard having a generally front flat imperforate surface for receiving and engaging said sign along a continuous line of engagement therewith and having a rear flat surface to help facilitate driving the standard into the ground;

a mounting bracket dimensioned for receiving a portion of said mounting standard therein;

said mounting bracket having a pair of spaced-apart downwardly extending sign receiving open slots;

each one of said downwardly extending slots terminating at a lower edge of said mounting bracket and configured in a shape substantially complementary to a marginal edge portion of said sign for receiving it;

each one of said downwardly extending slots including substantially equally sized spaced apart front and rear side edges for accommodating signs, having flat front and rear face portions, of different thicknesses thereinbetween;

said mounting bracket being generally U-shaped and including a pair of outwardly flared sidewall portions in their normal unstressed conditions;

said pair of sidewall portions being composed of flexible resilient material for enabling said sidewall portions to flex inwardly toward one another into a generally parallel disposition in response to manually applied forces by the user for helping to receive said sign within said downwardly extending slots and to snap back away from one another to grip forcible said sign therewithin when the user releases the manually applied forces on said sidewall portions so that said mounting bracket can secure said sign from the top prior to clamping said sign to said mounting standard thereby facilitating signal installation;

clamping means mounted threadably to said bracket for pressing said mounting standard front flat surface forcibly against an upper portion of said sign to clamp an upper portion of said sign between the rear side edges of said downwardly extending slots and said mounting standard, said clamping means engaging said rear flat surface of said mounting standard to press it flat against said sign to inhibit rotation of said sign relative to said mounting standard;

another mounting bracket dimensioned for receiving another portion of said mounting standard therein;

said other mounting bracket having a pair of spaced-apart upwardly extending U-shaped open sign receiving slots;

each one of said upwardly extending slots terminating at an upper edge of said other bracket an configured in a shape substantially complementary to another marginal edge portion of said sign for receiving it;

each one of said upwardly extending slots including substantially equally sized spaced apart front and rear side edges for accommodating signs having flat front and rear face portions of different thicknesses thereinbetween;

said other mounting bracket being generally U-shaped and including another pair of outwardly flared sidewall portions in their normal unstressed conditions;

said other pair of sidewall portions being composed of flexible resilient material for enabling said sidewall portions to flex inwardly toward one another into a generally parallel disposition in response to manually applied forces by the user for helping to receive said sign within said upwardly extending slots and to snap back away from one another to grip forcibly the sign therewithin when the user releases the manually applied forces on said sidewall portions so that said other mounting bracket can secure said sign from the bottom, prior to clamping said sign to said mounting standard thereby facilitating sign installation; and another clamping means mounted threadably to said other bracket for pressing said other portion of said mounting standard forcibly against a lower portion of said sign to clamp the lower portion of said sign between the rear side edges of said upwardly extending slots and said mounting standard, whereby said flat rear face of said sign is clamped to said flat surface of said mounting standard to engage said sign along a continuous line of engagement from its top to its bottom.

2. A portable sign support system according to claim 1, wherein said mounting standard is angle iron.

3. A portable sign support system according to claim 2, wherein said angle iron is generally L-shaped.

4. A portable sign support system according to claim 3, wherein said angle iron has a foot peg extending traversely therefrom.

5. A portable sign support system according to claim 1, wherein said mounting standard is a post being L-shaped in cross section throughout its length.

6. A portable sign support system according to claim 1, wherein said mounting bracket has a unitary construction and is composed of a plastic material.

7. A portable sign support system according to claim 6, wherein said plastic material is selected from a group consisting of polypropylene plastic and ABS plastic.

8. A portable sign support system according to claim 1, wherein said mounting bracket includes a bight portion integrally connected to a pair of oppositely disposed converging leg portions.

9. A portable sign support system according to claim 8, wherein the width of said bight portion is substantially wider than said mounting standard.

10. A portable sign support system according to claim 8, wherein individual ones of said slots are disposed in each one of said converging leg portions.

11. A portable sign support system according to claim 10, wherein said upwardly extending slots are disposed in general alignment with one another and are sufficiently wide to receive signs having different thicknesses.

12. A portable sign support system according to claim 1, wherein said clamping means is hand activated screw means.

13. A portable sign support system according to claim 12, wherein said hand-activated screw means include a screw with a plastic cap affixed thereto.

14. A portable sign support system according to claim 13, wherein said plastic cap is composed of polypropylene.

15. A portable sign support system according to claim 13, wherein said plastic cap includes a pair of oppositely disposed elongated outer arm means extending in diametrically opposing directions.

16. A portable sign support system according to claim 1, wherein said screw means includes at least one tool-activated screw.

17. A portable sign support system according to claim 16, wherein said tool-activated screws are Phillips-head screws.

18. In a portable sign support system having a sign for displaying a message, and a mounting standard for supporting the sign above a ground supporting surface, a sign mounting arrangement, comprising:

a mounting standard having a generally flat rigid leg including a front flat imperforate surface for receiving and engaging the sign along a continuous line of engagement therewith and having a rear flat surface; for driving into the ground;

a mounting bracket dimensioned for receiving a portion of said mounting standard therein;

said mounting bracket having a pair of spaced-apart downwardly extending sign receiving open slots;

each one of said downwardly extending slots terminating at a lower edge of said mounting bracket and configured in a shape substantially complementary to a marginal edge portion of the sign for receiving it;

each one of said downwardly extending slots including substantially equally sized spaced apart front and rear side edges for accommodating signs, having flat front and rear face portions, of different thicknesses thereinbetween;

said mounting bracket being generally U-shaped and including a pair of outwardly flared sidewall portions in their normal unstressed conditions;

said pair of sidewall portions being composed of flexible resilient material for enabling said sidewall portions to flex inwardly toward one another into a generally parallel disposition in response to manually applied forces by the user for helping to receive said sign within said downwardly extending slots and to snap back away from one another to grip forcibly said sign therewithin when the user releases the manually applied forces on said sidewall portions so that said mounting bracket can secure said sign from the top prior to clamping said sign to said mounting standard thereby facilitating signal installation;

clamping means adapted to threadably engage said bracket for pressing said mounting standard front flat surface forcibly against an upper portion of the sign to clamp the sign between the rear side edges of said downwardly extending slots and said mounting standard said clamping means engaging said rear flat surface of said mounting standard to press it flat against the sign to inhibit rotation of the sign relative to said mounting standard;

another mounting bracket dimensioned for receiving another portion of said mounting standard therein;

said other mounting bracket having a pair of spaced-apart upwardly extending U-shaped open sign receiving slots;

each one of said upwardly extending slots terminating at an upper edge of said other bracket an configured in a shape substantially complementary to another marginal edge portion of the sign for receiving it;

each one of said upwardly extending slots including substantially equally sized spaced apart front and rear side edges for accommodating signs having flat front and rear face portions of different thicknesses thereinbetween;

said other mounting bracket being generally U-shaped and including another pair of outwardly flared sidewall portions in their normal unstressed conditions;

said other pair of sidewall portions being composed of flexible resilient material for enabling said sidewall portions to flex inwardly toward one another into a generally parallel disposition in response to manually applied forces by the user for helping to receive said sign within said upwardly extending slots and to snap back away from one another to grip forcibly the sign therewithin when the user releases the manually applied forces on said sidewall portions so that said other mounting bracket can secure said sign from the bottom, prior to clamping the sign to said mounting standard thereby facilitating sign installation; and another clamping means mounted threadably to said other mounting bracket for pressing said other portion of said mounting standard forcibly against a lower portion of said sign to clamp the lower portion of said sign between the rear side edges of said upwardly extending slots and said mounting standard whereby the sign having a flat front and rear faces is clamped to a flat surface of said mounting standard at the top and bottom edges thereof, engaging the sign along a continuous line of engagement from top to bottom.

* * * * *

UNITED STATES PATENT AND TRADEMARK OFFICE

CERTIFICATE OF CORRECTION

PATENT NO. : 5,181,335

DATED : January 26, 1993

INVENTOR(S) : Harry V. Todd

It is certified that error appears in the above-identified patent and that said Letters Patent is hereby corrected as shown below:

Column 10, line 3, after "clamping" delete "said", and substitute therefor--the--.

Column 10, line 18, after "receiving", please insert --open--.

Column 10, line 20, before "bracket", delete "other", and substitute therefor--lower--.

Column 10, line 49, before "sign", delete "said" and substitute therefor--the--.

Column 10, line 50, before "sign", delete "said", and substitute therefor--the--.

Signed and Sealed this

Eighth Day of February, 1994

Bruce Lehman

*Attest:*

BRUCE LEHMAN

*Attesting Officer*

*Commissioner of Patents and Trademarks*